United States Patent [19]

Bertsch et al.

[11] Patent Number: 4,781,000

[45] Date of Patent: Nov. 1, 1988

[54] STRUCTURAL SUPPORT BRACE

[76] Inventors: Randall E. Bertsch, Bethel Rd.; Robin E. Bertsch, 10002 St. Clair's Retreat; Richard K. Garton, 5630 Prophet's Pass, all of Fort Wayne, Ind. 46825

[21] Appl. No.: 940,744

[22] Filed: Dec. 11, 1986

[51] Int. Cl.[4] ..... E04H 3/16

[52] U.S. Cl. ..... 52/169.8; 4/506

[58] Field of Search ..... 52/169.7, 169.8; 4/506

[56] References Cited

U.S. PATENT DOCUMENTS

| | | | |
|---|---|---|---|
| 4,015,379 | 4/1977 | Corson | 52/169.8 |
| 4,109,324 | 8/1978 | Cornelius | 52/169.7 |
| 4,118,809 | 10/1978 | Bertsch | 52/169.7 |
| 4,124,907 | 11/1978 | Laven | 52/169.7 |
| 4,232,491 | 11/1980 | Bumgarner | 52/169.7 |
| 4,333,186 | 6/1982 | Lankheet | 4/506 |

*Primary Examiner*—John E. Murtagh

*Attorney, Agent, or Firm*—Lundy and Walker

[57] ABSTRACT

A structural support brace for supporting the deck and wall of a swimming pool or similar structure comprising a body including an upwardly facing support surface for the deck, a plurality of stake guides and a plurality of stakes. The stakes are slideably positioned within the stake guides and securable within the stake guides at selected points. A sleeve is positioned on the stake guides. The sleeve provides a form for a poured concrete pillar. The pillar both anchors the brace and provides structural support for the deck.

12 Claims, 9 Drawing Sheets

STRUCTURAL SUPPORT BRACE

BACKGROUND OF THE INVENTION

The subject matter of the invention relates to a structural brace and more particularly to a structural support brace used for supporting the deck and coping of a swimming pool.

Several varieties of braces are utilized in the swimming pool industry. These braces support various pool wall sections, as well as the copings and decks which are poured from concrete. Problems have developed in the field because the braces have not been adequate to support the entire width of a poured concrete deck. The brace in combination with the backfill have proved inadequate with the result that cracks develop in the concrete deck after a period of time. The solutions utilized in attempts to overcome these problems have been insufficient, costly, and inadequate. The pool industry still requires a viable method of preventing stress fractures in both the pool, deck and coping.

It is therefore highly desirable to provide a new and improved structural support brace.

It is also highly desirable to provide a new and improved structural support brace which includes a method for pouring a concrete pillar as an integral component of the brace.

It is also highly desirable to provide a new and improved structural support brace which is efficient and easy to utilize in the construction process.

It is also highly desirable to provide a new and improved structural support brace wherein the form utilized to pour the concrete pillar is positioned on the brace body.

It is also highly desirable to provide a new and improved structural support brace which inherently anchors the brace and provides heavy duty horizontal as well as vertical support.

It is also highly desirable to provide a new and improved structural support brace that can be manufactured as a unit or in discrete components.

It is also highly desirable to provide a new and improved structural support brace which can be used both above and below the ground.

It is also highly desirable to provide a new and improved structural support brace which completely eliminates all elements which are susceptible to rust, corrosion, or rot.

It is also highly desirable to provide a new and improved structural support brace which minimizes the time and labor required in construction.

It is finally highly desirable to provide a new and improved structural support brace having all of the above features.

SUMMARY OF THE INVENTION

It is therefore an object of the invention to provide a new and improved structural support brace.

It is also an object of the invention to provide a new and improved structural support brace which includes a method for pouring a concrete pillar as an integral component of the brace.

It is yet another object of the invention to provide a new and improved structural support brace which is efficient and easy to utilize in the construction process.

It is yet another object of the invention to provide a new and improved structural support brace wherein the form utilized to pour the concrete pillar is positioned on the brace body.

It is yet another object of the invention to provide a new and improved structural support brace which inherently anchors the brace and provides heavy duty horizontal as well as vertical support.

It is yet another object of the invention to provide a new and improved structural support brace that can be manufactured as a unit or in discrete components.

It is yet another object of the invention to provide a new and improved structural support brace which can be used both above and below the ground.

It is yet another object of the invention to provide a new and improved structural support brace which completely eliminates all elements which are susceptible to rust, corrosion, or rot.

It is yet another object of the invention to provide a new and improved structural support brace which minimizes the time and labor required in construction.

It is finally an object of the invention to provide a new and improved structural support brace having all of the above features.

Briefly what is provided is a structural support brace for supporting the deck and wall of a swimming pool or similar structure comprising a body including an upwardly facing support surface for the deck, a plurality of stake guides and a plurality of stakes. The stakes are slideably positioned within the stake guides and securable within the stake guides at selected points. A sleeve is positioned on the stake guides. The sleeve provides a form for a poured concrete pillar. The pillar both anchors the brace and provides structural support for the deck.

BRIEF DESCRIPTION OF THE DRAWINGS

The above-mentioned and other features and objects of this invention and the manner obtaining them will become more apparent and the invention itself will be best understood by reference to the following description of an embodiment to the invention taken in conjunction with the accompanying drawings, wherein.

DESCRIPTION OF A SPECIFIC EMBODIMENT

Figure 1:
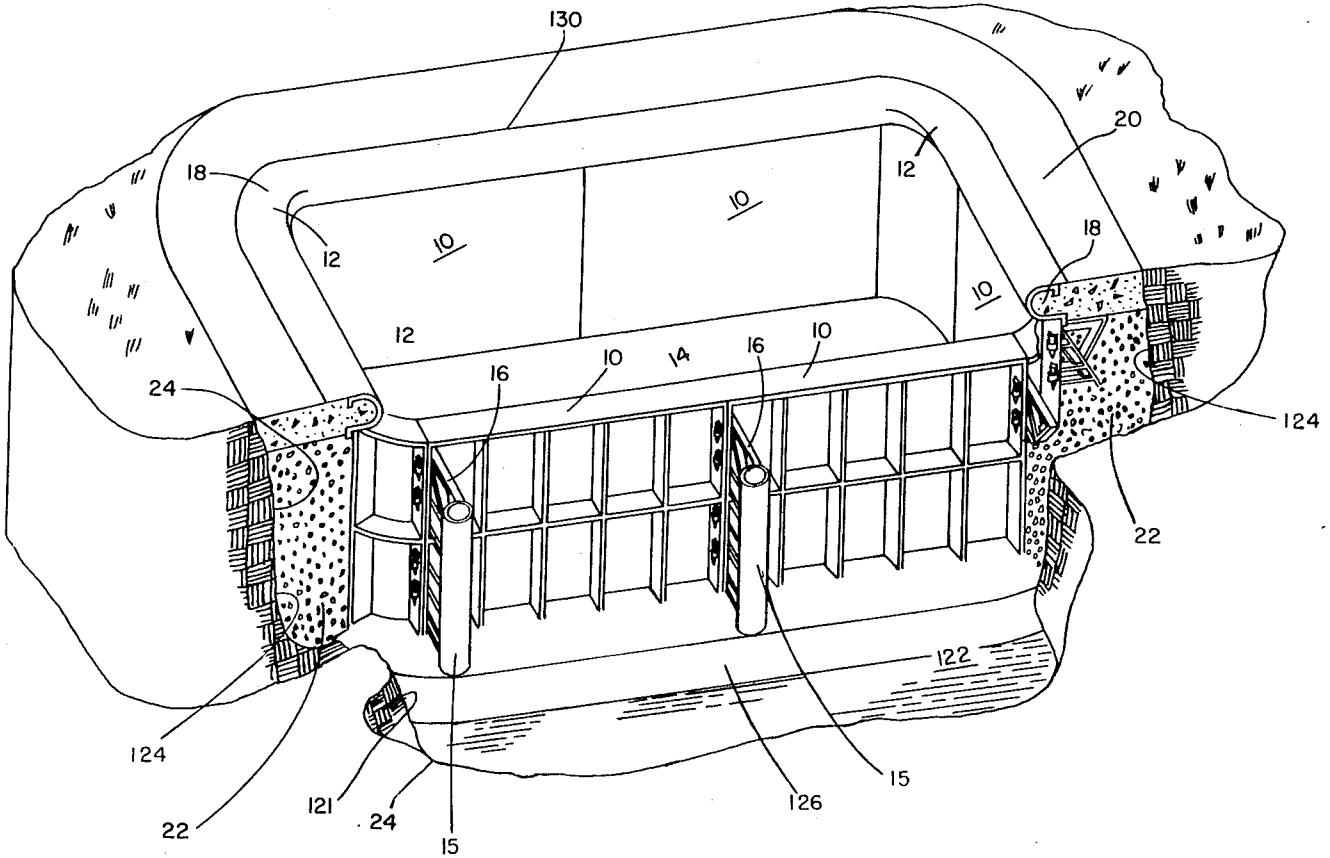
FIG. 1 is a perspective and broken away view of the swimming pool structure of the invention, showing the wall sections, the braces supporting the same, the excavation, the pool bottom, the back fill between the wall sections and the excavation, the coping and the deck.
Figure 10:
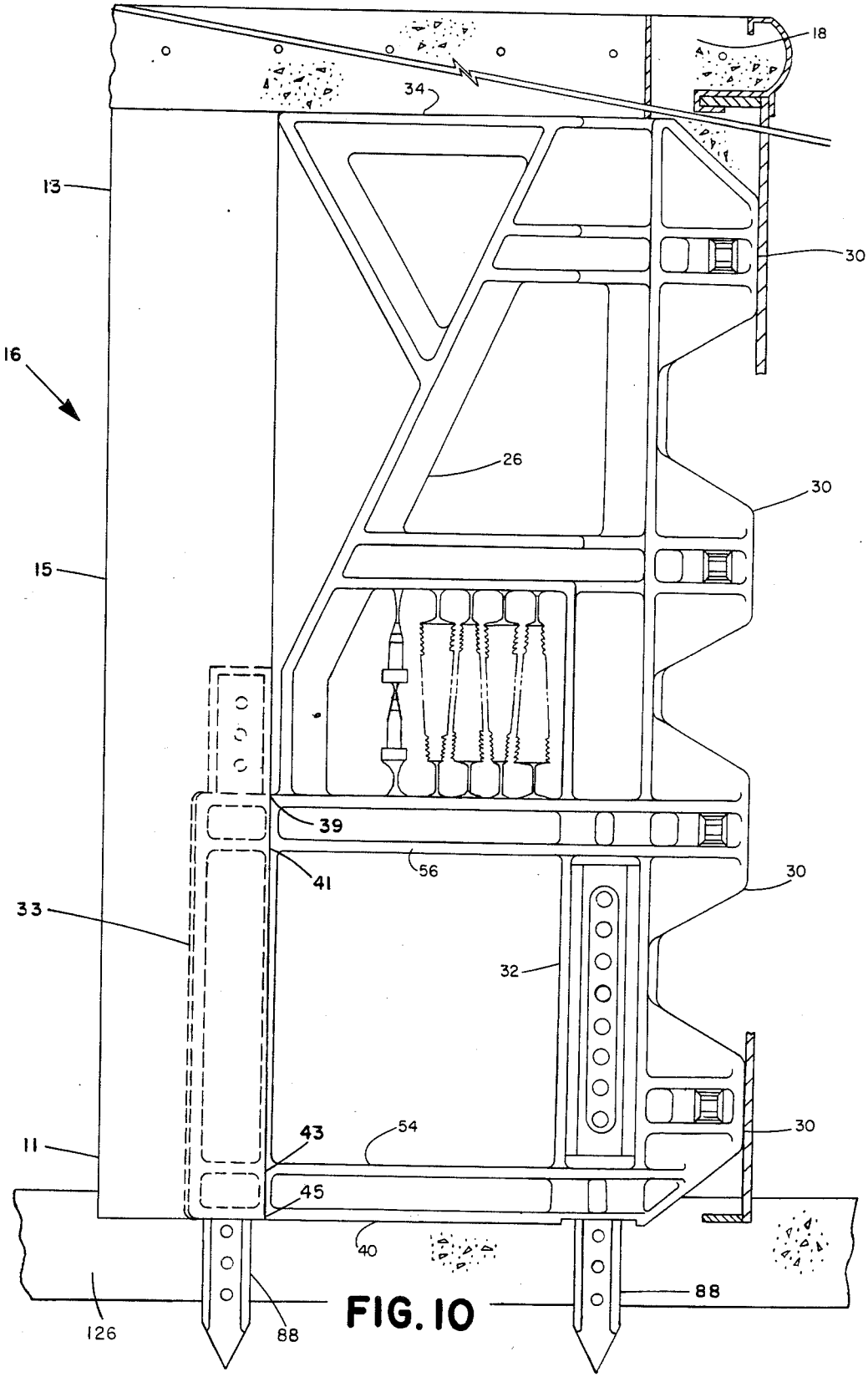
FIG. 10 is a side plan view of the invention illustrating the support brace and sleeve in position.

Referring now to FIGS. 1 and 10, the structural support brace 16 is illustrated in conjunction with a constructed swimming pool.

Structural support brace 16 includes body 26, sleeve 15, stakes 88, swimming pool wall 10, pool deck 20 and coping 18, wherein the pool deck and coping are concrete. Body 26 includes connectors 30 and stake guides 32, 33. Stakes 88 are slidably positioned within stake guides 32, 33.

Body 26, stakes 88, pool wall 10, pool deck 20, and coping 18 are each fully disclosed in U.S. Pat. Nos. 4,118,809 and 4,115,997 issued on Oct. 10, 1978 and Sept. 26, 1978 to Lyle E. Bertsch, respectively, wherein the method and apparatus for the pool construction in general is described.

Referring now to FIG. 1, there is shown the improved swimming pool structure of the invention mounted in the ground. The swimming pool structure includes the side wall sections 10 and corner wall sections 12, a pool bottom 14, a plurality of braces 16 supporting the wall sections 10, 12, a plurality of sleeves 15, footing 126, and back fill 22 around the braces and between the excavation 24 and pool walls 10, 12, coping 18 and a deck 20.

Referring now to FIGS. 2, 4, 5, and 7, brace 16 of the invention will be described in detail. Brace 16 has a body 26, a deck and coping support 28, connectors 30 and stake guides 32, 33.

The coping and deck support 28 has an upwardly facing surface 34 on which both the coping 18 and the deck 20 rest. Surface 34 defines the top of the brace 16. The deck and coping support 28 is connected to the body 26 by suitable bracing 36.

The connectors 30 protrude from the front surface 38 of the body 26. All of the connectors 30 are identical, and thus, the description of one will suffice for the description of all. Secured to each brace 16, in the specific embodiment illustrated, are four connectors 30. Connectors 30 are secured to the body 26 in a spaced-apart relation, there being one connector 30 adjacent the surface 34 and one connector 30 adjacent the bottom surface 40 of body 26. The other two connectors are positioned between the top most and bottom most connectors 30, the connectors 30 are generally equally spaced from each other.

Figure 2:
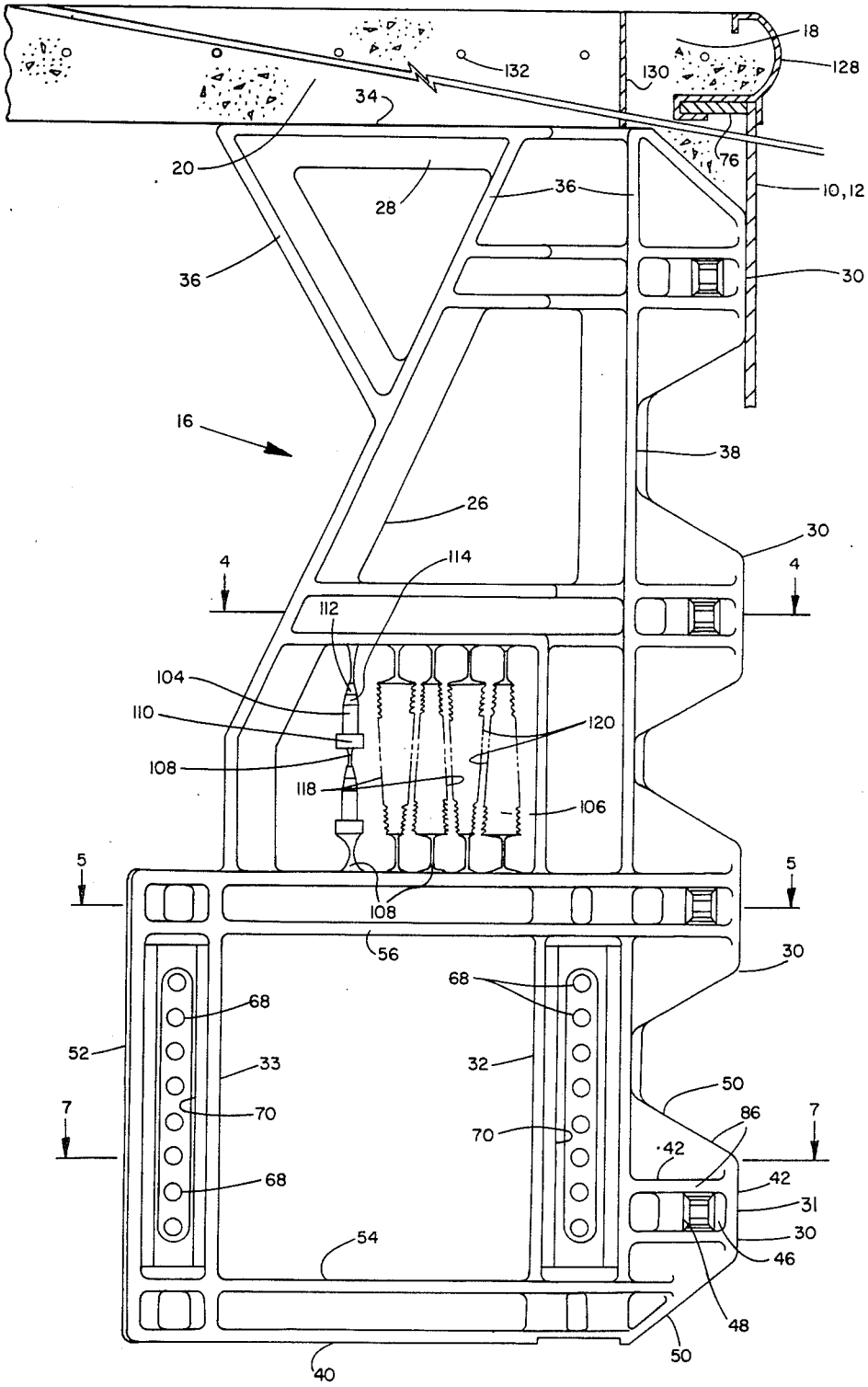
FIG. 2 is a side view of the improved wall brace of the swimming pool structure of the invention including the stake fastening and wall section securing means attached thereto showing a wall section, the coping and deck in cross-section.
Figure 4:
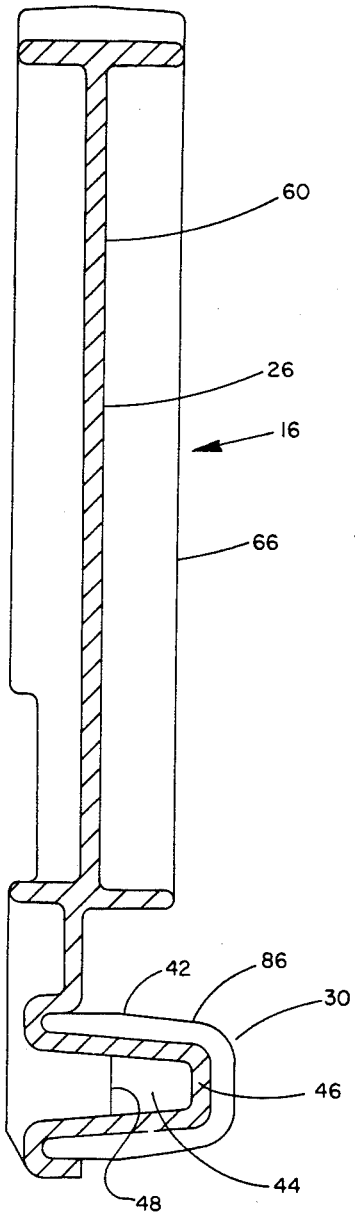
FIG. 4 is a sectional view of the brace illustrated in FIG. 2 taken substantially along the section line 4—4.
Figure 5:
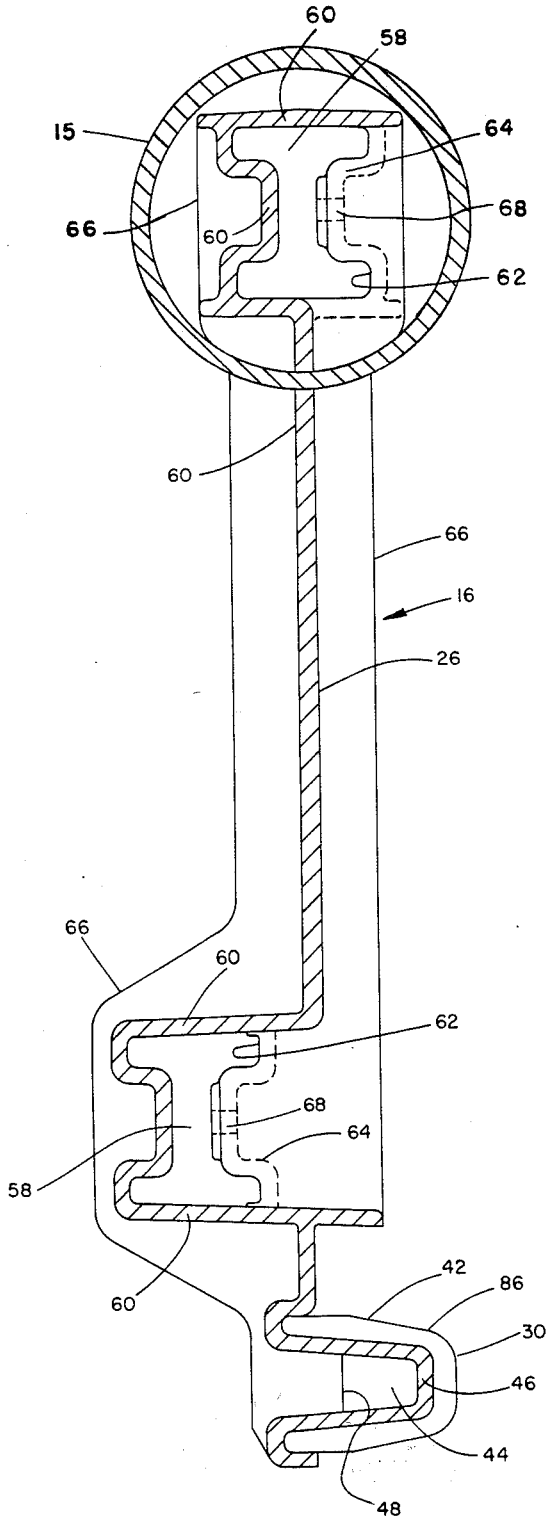
FIG. 5 is a sectional view of the brace illustrated in FIG. 2 taken substantially along the section line 5—5.
Figure 7:
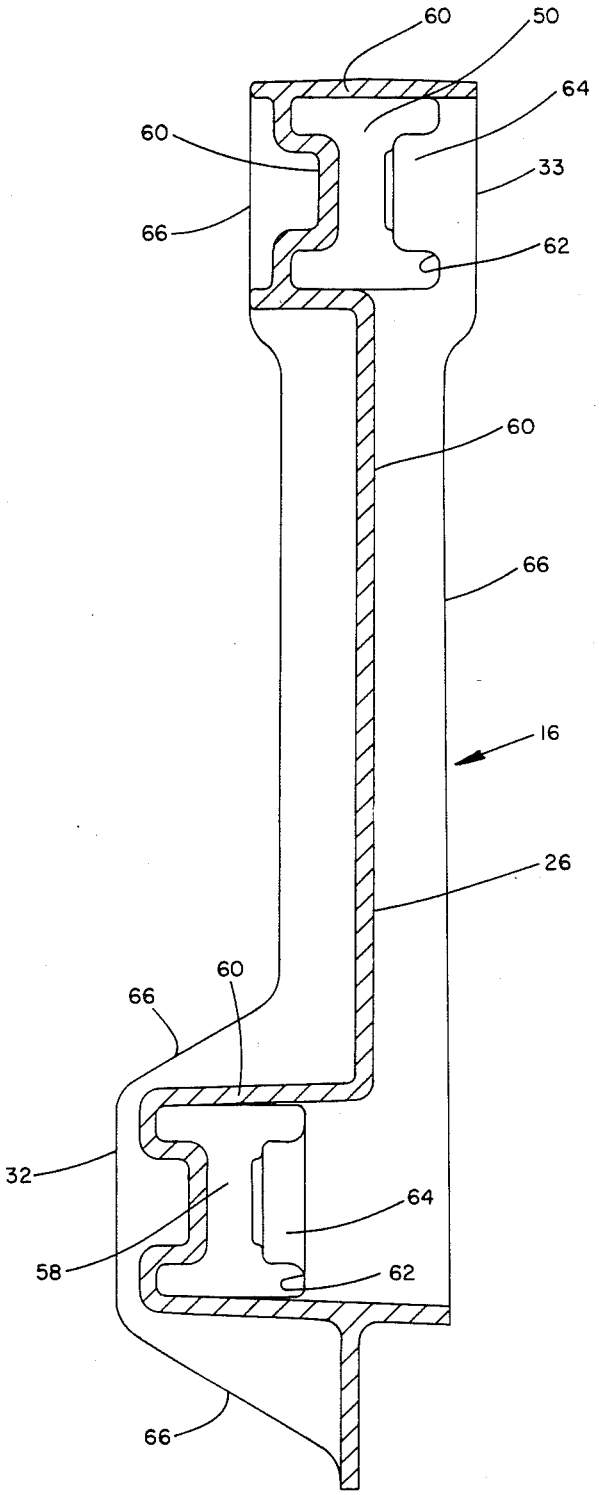
FIG. 7 is a sectional view of the brace illustrated in FIG. 2 taken substantially along the section line 7—7.

As shown in FIGS. 4, 5, and 7, all of the connectors 30 protrude from the body 26 to one side thereof. All of the connectors 30 comprise a flange 42 which generally defines the shape of the connector 30. Each connector 30 has an aperture 44 therein generally defined by a web 46 and a planar body surface 48. As shown in FIG. 2, the connectors 30 have distal end 31 and are secured to the body 26 by suitable bracing 50.

Stake guides 32, 33 are positioned adjacent the bottom 40 of the body 26. Stake guide 32 is positioned adjacent the lower two connectors 30. Stake guide 33 is spaced from stake guide 32 and defines the rear 52 of the body 26. Extending between stake guides 32 and 33 are body members 54 and 56. Body member or footing anchor 54 is positioned adjacent the bottom of brace 16; bottom surface 40 is the bottom surface of member 54. Member 56 is positioned adjacent the top of the stake guides 32, 33 and is shown to extend rearwardly from the lower of the intermediate connectors 30. As shown in FIGS. 5 and 7, stake guide 32 extends from body 26 in the opposite direction as connectors 30. In contrast, stake guide 33 is positioned generally on the center line of the brace 16.

Both of the stake guides 32 and 33 have openings 58 therein which generally conform to the shape of the stakes. Openings 58 are generally defined by a web 60, a body surface 62 and a boss 64 which extends from body surface 62 over an appreciable length of the stake guides 32, 33. Surrounding the webs 60 is a flange 66 which defines the general exterior shape of the stake guides 32, 33.

As above-mentioned, boss 64 extends from the body surface 62 substantially over the length of the stake guides 32, 33. FIG. 2 shows a side plan view of the boss 64. Extending through the boss 64 are a plurality of spaced-apart openings 68. The uppermost opening 68 is adjacent member 56 and the bottom most opening 68 is adjacent member 54. As best shown in FIG. 2, an opening 70 is formed in the web 60 so as to expose the boss 64 and the openings 68 as viewed in FIG. 2. The openings 68 extend entirely through the boss 64.

As illustrated in FIGS. 2, 4, 5, 6 and 7, each of the structural elements above-mentioned, in the specific embodiment illustrated, is integrally formed of a flange and web structure similar to conventional structural members having "I", "T", or the like cross-sectional shapes. The specific brace 16 illustrated can be totally integrally formed by molding utilizing conventional techniques.

Figure 3:
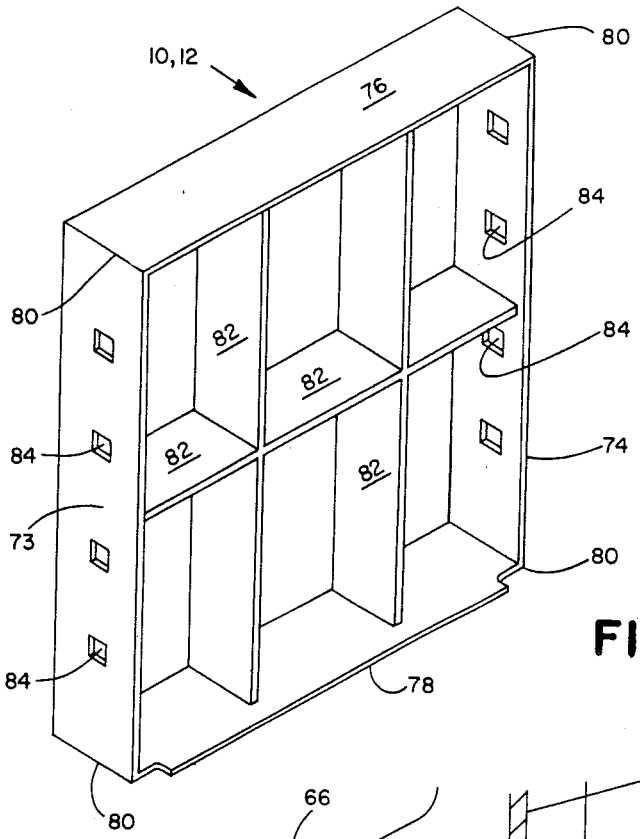
FIG. 3 is a perspective view of a wall section of the improved swimming pool structure of the invention.
Figure 6:
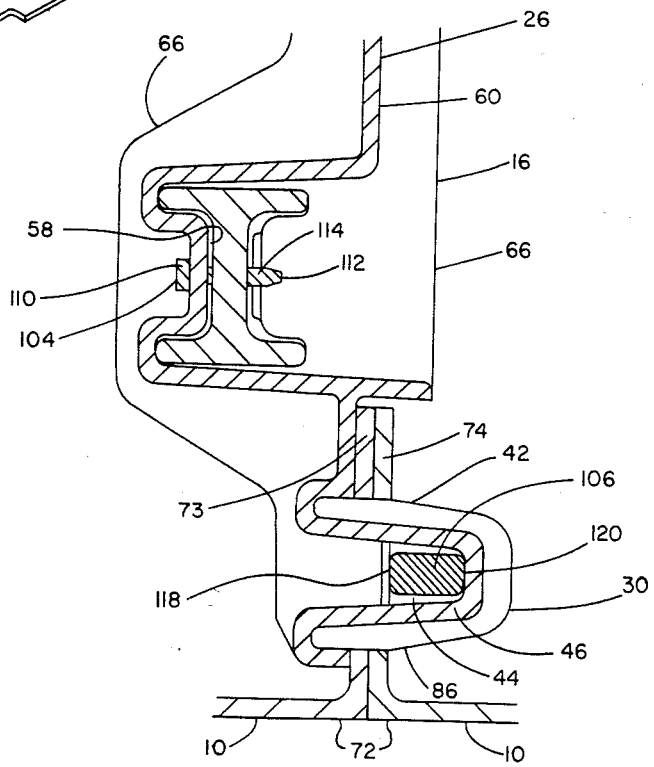
FIG. 6 is a fragmentary view like FIG. 5 showing the wall section stake and brace structure of the invention in an assembled condition.

Now referring to FIG. 3 and 6, the wall sections 10, 12 will be described. Each of these wall sections have a front surface 72 which, as will be explained hereinafter, defines the interior pool surface together with the bottom 14. Each of the wall sections 10, 12 also have opposite end flanges 73 and 74 and top and bottom flanges 76 and 78. Flanges 73 through 78 each extend rearwardly of the surface 72 and are connected together at the corners 80. Suitable bracing 82 is provided to extend between flanges 73 through 78 to give the wall sections 10, 12 suitable strength and rigidity. End flanges 73, 74 each have a plurality of spaced-apart openings 84 therein. Openings 84 are sized and shaped generally to conform with the size and shape of the connectors 30 as defined by the flange 42 and the bracing 50. It should be noted that the exterior surface 86 of the flanges 42 and bracing 50 are each tapered toward the distal ends 31 of the connectors 30 so as to provide a "tight" fit when the connectors 30 are positioned within the holes 84.

The surface 72 of each of the wall sections 10 is generally planar. Flanges 73 through 78 and bracing 82 all extend rearwardly of the surface 72 generally perpendicularly thereof. In contrast, the surface 72 of each of the corner wall sections 12 is generally cylindrical, being radiused about an axis extending generally perpendicularly of the planes which flanges 76 and 78 define. End flanges 73, 74 and the bracing 82 extend between top and bottom flanges 76 and 78 extend rearwardly of the surface 72 generally radially thereof. Each of the top and bottom flanges 76, 78 and the bracing 82 generally parallel thereto are part annular. Otherwise, wall sections 10, 12 are identical. In the specific embodiment illustrated in FIG. 3 and 6 entire wall sections 10, 12 can be molded as a single piece with the flanges 73 through 78 and the bracing 82 all integral. In preferred embodiments, an aesthetically pleasing design can be placed in the surface 72 and the entire wall sections 10, 12 can be molded of the same material as braces 16.

Figure 8:
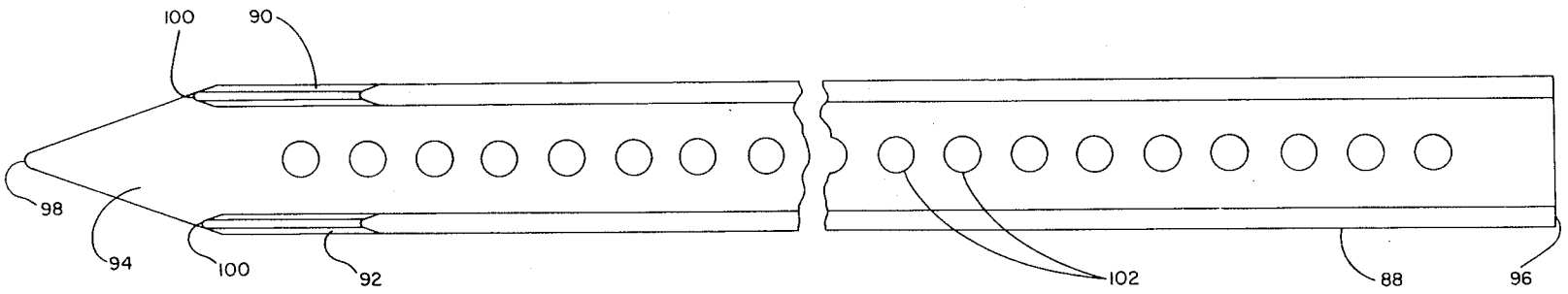
FIG. 8 is a broken side view of the stake of the improved swimming pool structure of the invention.
Figure 9:
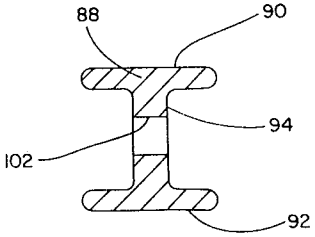
FIG. 9 is a sectional view of the stake illustrated in FIG. 8 taken substantially along the section line 9—9.

FIGS. 8 and 9 illustrate the stakes 88 of the invention. Stakes 88 as shown in FIG. 9 have a cross-sectional shape geometrically similar to the opening 58 in the stake guides 32, 33. Specifically, each of the stakes 88 includes opposite flange portions 90, 92 and an intermediate web porton 94. Web portion 94 extends the entire length of the stake 88 from the head 96 to the point 98. As shown in FIG. 8, the point 98 is essentially formed of the web 94 inasmuch as the flanges 90, 92 terminate at a position 100 spaced from the point 98. Positioned in the center of the web 94 are a plurality of openings 102. Openings 102 are spaced-apart and aligned on the center line of the stake 88. The uppermost opening 102 is adjacent the head 96 and the lower most opening 102 is adjacent the point 98.

By comparing FIG. 9 with FIGS. 4, 5, and 7, it will be readily seen that the cross-sectional shape of the stake 88 between the head 96 and the end of the flanges 90, 92 is essentially the same as the cross-sectional shape of the opening 58 of stake guides 32, 33 such that stakes 88 can be slidably positioned within the openings 58 of stake guides 32, 33 and held against rotation, as will be explained hereinafter. The particular spacing of the openings 102 and the spacing of the openings 68 in the boss 64 of the stake guides 32, 33 are chosen such that at least one opening 102 and one opening 68 are positioned coaxially in each position the stake 88 might be desirably secured within the stake guides 32, 33. In a specific embodiment, the spacing of the openings 68, 102 are chosen such that each fraction of an inch that the stake 88 is moved within the stake guides 32, 33 different pairs of openings 68, 102 become coaxial. In a preferred embodiment, different pairs of openings 68, 102 become coaxial each one quarter inch that the stake 88 is moved within the stake guides 32, 33.

In the specific embodiment illustrated, stake 88 is again formed so as to have the cross-sectional shape of a conventional "I" beam. As illustrated in the drawing, the stake 88 can be molded from the same material as the wall sections 10, 12 and the braces 16 are made.

As will be mentioned hereinafter, the swimming pool structure of the invention also includes a plurality of pins 104 and a plurality of wedges 106. Pins and wedges 104 and 106 can be molded integrally with the brace 16 and connected thereto by break away portions 108. Thus, pins and wedges 104 and 106 are shown in FIG. 2. Each and includes a head 110, a tip 112 and a detent 114. Each of the wedges 106 has a plurality of teeth 116 covering the opposite sides 118, 120 thereof. Both pins 104 and wedges 106 are shown in cross-section in FIG. 6.

In a preferred embodiment, the wall sections 10, 12, the braces 16, the stakes 88, the pins 104, the wedges or pegs 106, can all be molded, as illustrated, from structural foam. Conventionally, the pool bottom 14, the coping 18 and the deck 20 are all constructed of concrete. The back fill 22 is generally gravel or sand or the like.

Referring now to FIGS. 1 and 10, poured concrete form or sleeve 15 is slidably positioned over rear stake guide 33, contacting body members 54 and 56 of body 26.

In the specific embodiment illustrated, form or sleeve 15 has a lower portion 11 and upper portion 13 wherein upper portion 13 is coterminous with upper surface 34 of body 26, and lower portion 11 is coterminous with the lower portion 40 of body 26.

Sleeve 15 functions as a form wherein concrete is poured to form a concrete pillar. This concrete pillar extends from deck 20 to footing 126 and is poured with deck 20. The pillar anchors body 26 and lends both horizontal and vertical heavy duty support to deck 20 and coping 18. The problems resulting from the deck 20 and coping 18 cracking with time as a result of back fill, settling, weather, deck loading and other factors are thereby minimized by using structural support brace 16 and sleeve 15.

Figure 11:
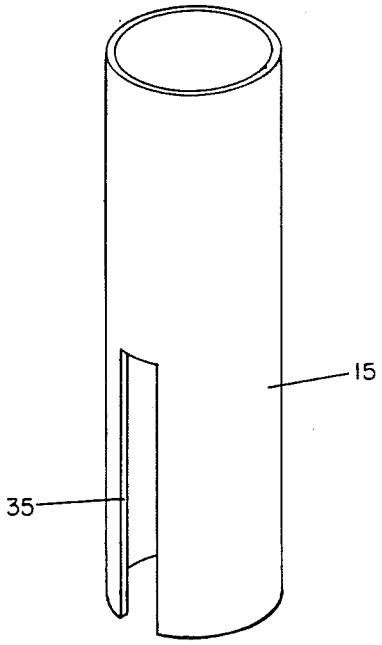
FIG. 11 is a perspective view of the sleeve of the invention.
Figure 12:
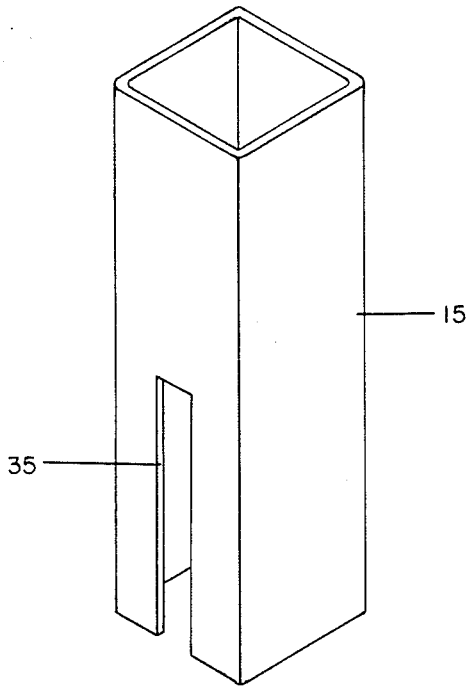
FIG. 12 is a perspective view of an alternative sleeve of the invention.

Referring now to FIGS. 11 and 12, form or sleeve 15 is shown in detail. FIG. 11 shows a cylindrical form 15 which includes a rectangular slot 35. Form 15 is positioned over stake guide 33 by slidably positioning the stake guide within rectangular slot 35. Slot 35 is of a dimension wide enough to accommodate stake guide 33 and long enough such that the bottom portion of form 15 is coterminous with structural body member 54 as shown in FIG. 10. FIG. 12 shows an alternative form 15, wherein form 15 is generally rectangular in shape. Both shapes of form 15 have diametric or length and width cross-sectional dimensions which at their minimum are controlled by the dimensions of brace body 26 and their maximum can be of any size necessary to achieve the objects of this invention.

Referring again to FIG. 10, sleeve or form 15 is shown slidably positioned over stake guide 33. Rectangular slot 35, as shown in FIGS. 11 and 12, contacts body 26 at points 39, 41, 43 and 45. In the embodiment illustrated, the dimensions of the rectangular slot 15 are such that the sleeve is frictionally held on stake guide 33 at points 39, 41, 43 and 45.

In an alternative embodiment, the lower portion 11 of sleeve 15, is not coterminous with body member 40 as shown in FIG. 10, but continues downwardly over stake 88 until the sleeve contacts the ground or filling material utilized in the construction.

When deck 20 and footing 126 are poured, it would then anchor wall sections 10, 12 and both sleeve or form 15 and support brace 16. Similarly, in other alternative embodiments, the upper portion 13 of sleeve 15 would not be coterminous with upper portion 34 of body 26 and would continue upward into deck 20.

Referring now to FIGS. 1, 5 and 10, form or sleeve 15 is shown slidably positioned over, and frictionally held on, stake guide 33 of body 26. In alternative embodiments, the sleeve could be dimensioned such that it would not contact stake guide 33, but the sleeve 15 could be large enough wherein the contact points could be anywhere along body members 56 and 54 of flanges 66 inwardly of points 39, 41, 43 and 45.

In an alternative construction, sleeve or form 15 could be manufactured as an integral portion of body 26. In this construction, body 26 and sleeve 15 would comprise a unitary device, thereby eliminating the slidable positioning of the sleeve on body 26.

As can readily be seen by one skilled in the art sleeve 15 could be manufactured out of a number of suitable materials such that it would hold wet concrete for a period of time until the concrete sets.

Referring now to FIG. 1, the method of erecting the swimming pool structure of the invention below ground will now be described. Once the site of the swimming pool is properly located, a hole 24 is excavated in the ground having a bottom with upstanding sides 121 shaped to geometrically conform to the shape of the bottom of the swimming pool. This bottom and upstanding sides 121 of the excavation or hole will form the exterior surface of the bottom 14 of the swimming pool, as will be explained hereinafter.

At the top of the upstanding sides 121 of the bottom of the excavation 24 and spaced from the ground surface there will be formed a lip 122 which will extend generally horizontally outwardly from the upstanding bottom sides 121 of the excavation 24 all around the pool. The width of lip 122 can vary but in general should be sufficiently larger than the longitudinal dimension of the brace 16 a shown in FIG. 5 to allow workmen to connect the braces 16 to the wall sections 10, 12, to position and secure the stakes 88 thereto, and to position the sleeves thereon, as will be described hereinafter. Upstanding from the lip 122 is a excavation side 124 which basically defines the width of the lip 122. Side 124 extends from ground level to the lip 122; whereas the upstanding bottom wall 121 extends generally downwardly from the lip 122. Care must be taken that the upwardly facing surface of the lip 122 is generally parallel with the ground level and is located at the proper dimension from ground level, as will become more apparent from the description hereinbelow.

Once the excavation 24 is completed and is generally properly dimensioned and shaped, a plurality of wall sections 10, 12 are arranged on the lip 122. It should be understood that the edge of the lip 122 will generally conform to the exterior surface of the pool bottom 14.

Pool sections 10, 12 are now assembled together. This is done by placing each of the sections 10, 12 in end to end relation with the end flange 73 of one section in abutment with the end flange 74 of the adjacent wall section. A brace 16 is positioned as shown in FIG. 1 with regard to each of the abutted flanges 73, 74. In this position, the connectors 30 are each positioned within the openings 84 of the abutted end flanges 73, 74 as shown in FIG. 6. When the wall sections 10, 12 are properly positioned in the aforedescribed end to end relation with the flanges 73, 74 adjacent wall sections in abutment, the surfaces 72 of adjacent wall sections and the top flanges 76 and the bottom flanges 78 should all define generally continuous exterior surfaces. In this position, the openings 84 in the end flanges 73 and 74 mate and are coaxial. Further, the openings 84 being both sized and shaped alike, connectors 30 can be easily positioned therein.

The wedges 106 are removed from braces 16, by removing the break aways 108 (See FIG. 2) and are positioned in the openings 44 of the connectors 30 and wedged therein. The teeth 116 of the wedges 106 engage the flanges 73, 74 and the web 46 so as to prevent their unintentional removal. By this means, the flanges 73 and wedge 74 are wedged together tightly and the braces 16 are connected to the wall sections 10, 12. The connected together wall sections 10, 12 are positioned such that the surfaces 72 are positioned so as to define the pool interior surface and the stakes 88 are positioned within the stake guides 32, 33 and driven into the lip 122. The stakes 88 will support the wall sections 10, 12 in position and hold the wall sections 10, 12 in alignment with the proposed pool interior.

As soon as all of the braces 16 are so connected and all of the stakes 88 are driven into the lip 122, the interior shape of the swimming pool will be accurately defined by the lower portion of the continuous surface defined by the individual surfaces 72 of the wall sections 10, 12 and each of the wall sections 10, 12 will be resting on the lip 122. However, inasmuch as each of the stakes 88 are slidably positioned within the stake guides 32, 33 of braces 10, each of the wall sections 10, 12 can be raised in position and tilted forwardly and rearwardly of the surfaces 72 on both sides of the vertical.

Each of the wall sections next must be adjusted as to grade and the vertical. This is achieved by raising each of the wall sections 10, 12 by slidably moving the braces 16 with respect to the fixed stakes 88. As each wall section is positioned correctly in respect to grade and the vertical, the pins 104 are removed from their position in the brace 16 as shown in FIG. 2 by removing the break aways 108 and driven into the appropriate pair of openings 68, 102 which are coaxial in the proper position. This adjustment as to altitude and attitude of each of the wall sections 10, 12 is made all around the periphery of the pool. Once the pins 104 are driven into the appropriate pair of openings 68, 102, the detents 114 prevent their unintentional removal.

Once this procedure is completed, the wall sections 10, 12 are each positioned exactly where desired with regard to the interior of the pool, the grade level, and the vertical, and are held sturdily in position by the braces 16. The sleeves 15 are then correctly positioned on stake guide 33 of each brace 16. The pool structure is now ready for the pouring of the bottom 24 or sanding as desired. The bottom is poured or sanded in a conventional manner to include a footing 126 which surrounds the bottom flange 78 of the wall sections 10, 12, braces 16, and sleeves 15 as shown in FIG. 1

Once the bottom 24 and the footing 126 has been poured, the back fill 22 can be placed in position between the wall sections 10, 12 and the upstanding hole walls 124 as shown in FIG. 1. The back fill 22 in a preferred embodiment is gravel. The top of the back fill 22 is leveled to generally coincide with the plane defined by the surfaces 34 of the coping and deck supports 28 of the braces 16. Once the back fill 22 is properly positioned, and the desired coping facing 128 is attached to the top flange 76 of the wall sections 10, 12 (see FIG. 2), the coping 18 and sleeves 15 are poured. Sequentially following the pouring of the coping 18 and sleeves 15, and generally before the concrete of the coping 18 and sleeves 15 sets, the deck 20 is poured. The concrete pillar formed by sleeve 15 then becomes an integral component of deck 20. The coping 18, deck 20, and sleeves 15 are all anchored by concrete footing 126. Conventionally an expansion joint 130 is positioned between the coping 18 and the deck 20. Suitable reinforcing rods 132 can be positioned within the coping 18, the deck 20 and sleeves 15 as desired.

The method of erecting the swimming pool structure of the invention above the ground is similar to the method of erecting the swimming pool structure of the invention below the ground as above-described. Once the site of the swimming pool is properly located, the ground which will serve as the pool bottom is properly prepared and shaped. Generally, no excavation is required, however, leveling and the like may be necessary. Surrounding the pool bottom, an annular lip 122 is prepared which will support the pool wall sections 10, 12 and the braces 16. Annular lip 122 is desirably shaped to be generally horizontal and planar at an altitude slightly below the anticipated altitude of the pool bottom to provide a proper connection between the pool bottom and the wall sections. To achieve this result, the pool bottom and the lip can be initially formed in the same plane and the pool bottom raised in elevation by sanding or the like subsequent to the installation of the wall sections 10, 12.

The erection of the pool wall sections 10, 12 on the lip 122 is accomplished in the same manner as above mentioned. The pool sections are first arranged on the lip 122 and the pool sections 10, 12 are assembled together and to the braces 16. The wall sections 10, 12 are positioned such that the surfaces 72 define the interior surface of the pool and the stakes 88 are positioned within the stake guides 32, 33 and driven into the lip 122. No additional support is required for the pool walls other than the braces 16 and the stakes 88. As soon as all of the braces 16 are connected to the wall sections 10, 12 and all of the stakes 88 are driven into the lip 122, the wall sections are each adjusted as to altitude and attitude, and the stakes are secured to the braces 16 as above described.

Once this procedure and the above-mentioned connection between the pool bottom and the wall sections 10, 12 is completed, the pool structure is completed and may be lined with a conventional liner, filled with water and used. If desired, a deck can be constructed of redwood or the like and supported on the coping and deck supports 28 of the braces 16. Similarly, a decorative exterior wall or fence may be constructed to hide from view the braces 16, sleeves 15, walls 10, 12 and footing 126 if desired.

While there have been described above the principles of this invention in connection with specific apparatus, it is to be clearly understood that this description is made only by way of example and not as a limitation to the scope of the invention.

What is claimed is:

1. A swimming pool brace and poured concrete pillar form comprising a brace body, said body having an upwardly facing support for a pool deck and a bottom footing anchor, means for connecting said body to a pool wall, a separate poured concrete pillar form, and means for fixing said form to said body, said form extending between said deck support and said anchor, said brace body and concrete pillar form being connected to each other and to said wall and prior to the pouring of concrete being a stable wall support and stable pillar concrete form facilitating the pouring of said pool footing, pillar and deck.

2. The brace of claim 1 further comprising a plurality of spaced apart stake guides, one of said stake guides being adjacent to said connecting means, the other of said stake guides being remote therefrom, a plurality of stakes, one of said stakes being adapted to be positioned in each of said stake guides, means for securing said stakes when positioned in said stake guides to said braces independently of each other, said brace and pool wall being supported by said stakes, whereby said wall may be positioned, adjusted in both altitude and attitude so as to position said wall section surfaces in a common plane, and held in position prior to pouring the concrete.

3. The brace of claim 1 wherein said securing means comprises a slot in said form, said form being positioned over said body with said body positioned within said slot.

4. The brace of claim 3 wherein said slot has a slot opening, said slot opening being in the lower edge of said form.

5. The brace of claim 3 wherein said form is tubular in shape and said slot is generally rectangular in size to fit said brace body, said form being frictionally held in position on said brace body.

6. A swimming pool comprising a plurality of wall sections, a plurality of braces, said braces each having an upwardly facing support for a pool deck, means for fastening said braces to said wall sections, each of said braces including at least two spaced apart stake guides, one of said stake guides being adjacent to said wall sections, the other of said stake guides being remote therefrom, a plurality of stakes, one of said stakes being adapted to be positioned in each of said stake guides, means for securing said stakes when positioned in said stake guides to said braces independently of each other, said wall sections being supported by said stakes, a plurality of poured concrete forms, and means for fixing said forms to said braces, said forms extending between said deck support and the bottom of said stake guides, whereby said wall sections may be positioned, adjusted in both altitude and attitude so as to position said wall section surfaces in a common plane and held in position prior to pouring the concrete, and said wall sections, footing, braces, forms, and pool deck form a rigid load-bearing pool structure.

7. A swimming pool comprising a plurality of wall sections, each of said wall sections having a front surface and opposite ends, said wall sections being positioned in end to end relation with said ends of adjacent ones of said sections abutting each other, said front surface of said wall sections forming a generally continuous surface when said wall sections are in said end to end relation, means for fastening said wall sections together, a plurality of braces, means for fastening said braces to said wall sections, said braces extending from said wall sections rearwardly thereof, each of said braces having a plurality of spaced apart stake guides therein, one of said stake guides being adjacent said wall sections, the other of said stake guides being remote therefrom, each of said stake guides having a stake slidably positioned therein, means for securing said stakes when positioned in said stake guides to said braces, said stakes being secureable in said stake guides to said braces by said stake securing means in a plurality of different positions, said wall sections being supported by said stakes, each of said braces including a support with an upwardly facing deck supporting surface, said support surface extending rearwardly of said wall sections when said braces are fastened to said wall sections, means including said stakes and said stake guides and said stake securing means for positioning each of said deck support surfaces generally in the same plane, a plurality of poured concrete forms, means for fixing one of said forms to each of said braces, said forms extending between said support surfaces and the bottom of said braces, a footing surrounding a bottom portion of said wall sections, braces and concrete forms, a deck supported on said support surfaces whereby said wall sections, footing, braces, forms and deck form a rigid load bearing pool structure.

8. A structural brace and poured concrete pillar form comprising a brace body, said body having an upwardly facing support for an overhead structure and a bottom footing anchor, means for connecting said brace body to an adjacent braced structure, a separate poured concrete pillar form, and means for fixing said pillar form to said body, said form extending between said support and said anchor, said brace body and concrete pillar form being connected to each other and to said braced structure and prior to the pouring of concrete being a stable support and stable concrete pillar form facilitating the pouring of said overhead structure, footing and pillar.

9. The brace of claim 8 further comprising a plurality of spaced apart stake guides, one of said stake guides being adjacent to said connecting means, the other of said stake guides being remote therefrom, a plurality of stakes, one of said stakes being adapted to be positioned in each of said stake guides, means for securing said stakes when positioned in said stake guides to said braces independently of each other, said brace and adjacent structure being supported by said stakes, whereby said adjacent structure may be positioned, adjusted in both altitude and attitude and held in position prior to pouring the concrete.

10. The brace of claim 8 wherein said fixing means comprises a slot in said form, said form being positioned over said body with said body positioned within said slot.

11. The brace of claim 10 wherein said slot has a slot opening, said slot opening being in the lower edge of said form.

12. A swimming pool comprising a plurality of wall sections, a plurality of braces, said braces each having an upwardly facing deck-supprting surface, means for fastening said braces to said wall sections, each of said braces including a stake guide, said stake guides being remote from said wall sections, a plurality of stakes, one of said stakes being adapted to be slidably positioned in each of said stake guides, means for securing said stakes when positioned in said stake guides to said braces independently of each other, said supporting surfaces extending rearwardly of said wall sections when said braces are fastened to said wall sections, means including said stakes and said stake guides and said stake securing means for positioning each of said deck support surfaces generally in the same plane, a plurality of poured concrete forms, means for fixing one of said forms to each of said braces, said forms extending between said support surfaces and the bottom of said braces, a footing surrounding a bottom portion of said wall sections, braces and concrete forms, a deck supported on said support surfaces whereby said wall sections, footing, braces, forms, and deck form a rigid load bearing pool structure.

* * * * *